US006477741B2

(12) United States Patent
Hösel

(10) Patent No.: US 6,477,741 B2
(45) Date of Patent: Nov. 12, 2002

(54) APPARATUS FOR DETECTING SEPARATED WASTE IN A FIBER PROCESSING MACHINE

(75) Inventor: Fritz Hösel, Mönchengladbach (DE)

(73) Assignee: Trützschler GmbH & Co. KG, Möchengladbach (DE)

( * ) Notice: Subject to any disclaimer, the term of this patent is extended or adjusted under 35 U.S.C. 154(b) by 0 days.

(21) Appl. No.: 10/024,361

(22) Filed: Dec. 21, 2001

(65) Prior Publication Data

US 2002/0078532 A1 Jun. 27, 2002

(51) Int. Cl.[7] ..... D01G 15/76
(52) U.S. Cl. ..... 19/107; 19/200
(58) Field of Search ..... 19/65 R, 98, 105, 19/106 R, 107, 108, 109, 112, 200, 202, 203, 204, 205

(56) References Cited

U.S. PATENT DOCUMENTS

| | | | | | |
|---|---|---|---|---|---|
| 4,858,277 | A | * | 8/1989 | Pinto et al. | 19/105 |
| 5,130,559 | A | * | 7/1992 | Leifeld et al. | 19/65 A |
| 5,146,652 | A | * | 9/1992 | Leifeld | 19/200 |
| 5,255,415 | A | * | 10/1993 | Leifeld et al. | 19/107 |
| 5,313,688 | A | * | 5/1994 | Leifeld et al. | 19/107 |
| 5,546,635 | A | * | 8/1996 | Leifeld | 19/200 |
| 5,613,278 | A | * | 3/1997 | Temburg | 19/105 |
| 5,761,771 | A | * | 6/1998 | Leifeld | 19/105 |
| 5,819,373 | A | * | 10/1998 | Schlichter et al. | 19/0.21 |
| 5,917,591 | A | * | 6/1999 | Schlichter | 19/80 R |
| 6,029,317 | A | * | 2/2000 | Meile et al. | 19/145.5 |
| 6,249,935 | B1 | * | 6/2001 | Leifeld | 19/200 |

FOREIGN PATENT DOCUMENTS

| | | | | |
|---|---|---|---|---|
| DE | 39 28 279 | | 2/1991 | |
| DE | 40 18 847 | A1 * | 12/1991 | D01G/9/14 |
| DE | 195 37 846 | A1 * | 7/1996 | D01G/9/00 |
| DE | 197 22 582 | | 2/1998 | |
| DE | 197 16 792 | | 10/1998 | |
| DE | 198 47 237 | | 8/1999 | |
| EP | 0 399 315 | | 11/1990 | |
| GB | 2 354 011 | | 3/2001 | |

* cited by examiner

*Primary Examiner*—Gary L. Welch
(74) *Attorney, Agent, or Firm*—Venable; Robert Kinberg

(57) ABSTRACT

A fiber processing machine includes a clothed roll having a surface for entraining fiber material thereon; a housing at least partially surrounding the clothed roll and conforming to the roll surface; a separating opening provided in the housing and extending along and adjacent a circumferential portion of the roll for receiving waste material thrown from the roll; a waste conduit leading from the separating opening for carrying waste material away from the roll; a camera adjoining the conduit for capturing pictures of the waste material flowing therein; and an electronic image processing device connected to the camera.

14 Claims, 7 Drawing Sheets

APPARATUS FOR DETECTING SEPARATED WASTE IN A FIBER PROCESSING MACHINE

CROSS REFERENCE TO RELATED APPLICATION

This application claims the priority of German Application No. 100 63 861.9 filed Dec. 21, 2000, which is incorporated herein by reference.

BACKGROUND OF THE INVENTION

This invention relates to an apparatus in a fiber processing machine such as a cleaner, an opener, a carding machine or the like for detecting separated waste discharged by separating elements and collected in a waste collecting device. The apparatus comprises an optical measuring device which examines the dirt content of the waste.

European Patent No. 0 399 315 describes an apparatus in which the beater pins of a cleaning roll deliver the fiber tufts over cleaning bars which are adjustable for changing the cleaning intensity. Underneath the cleaning bars a light/dark sensor measures the brightness as a measure of the dirt content in the waste that was separated by the cleaning bars and collected in a funnel-like collecting device. The waste is transported away in predetermined intervals by a suction device which is arranged at the lower end of the collecting device. The brightness of the separated waste measured by the light/dark sensor is inputted in a control device as a signal and is displayed on a display device. It is a disadvantage of such a prior art arrangement that the sensor serves exclusively for detecting the proportion of dirt and thus a detection of the proportion of useful (good) fibers is not performed. It is a further drawback that the sensor is only capable of determining brightness differences so that a determination concerning the composition of the waste, particularly concerning the type of the components of the dirt content in the waste material is not possible.

SUMMARY OF THE INVENTION

It is an object of the invention to provide an improved apparatus of the above-outlined type from which the discussed disadvantages are eliminated and which, in particular, makes possible a detection of the useful fiber proportion in the waste and also makes possible a determination of the waste composition.

This object and others to become apparent as the specification progresses, are accomplished by the invention, according to which, briefly stated, the fiber processing machine includes a clothed roll having a surface for entraining fiber material thereon; a housing at least partially surrounding the clothed roll and conforming to the roll surface; a separating opening provided in the housing and extending along and adjacent a circumferential portion of the roll for receiving waste material thrown from the roll; a waste conduit leading from the separating opening for carrying waste material away from the roll; a camera adjoining the conduit for capturing pictures of the waste material flowing therein; and an electronic image processing device connected to the camera.

The measures according to the invention make possible an automatic detection of the useful fiber content in the waste and an evaluation of its composition. With the aid of the electronic camera and the image evaluating device connected thereto signals may be obtained which represent an exact information concerning the proportion of the useful fibers in the waste and which are used for setting the waste separating elements. Further, the electronic image evaluation permits to draw reliable conclusions concerning the waste composition (for example, neps, shell fragments, trash, and useful fibers). Such information indicates working characteristics of the machine and allows modifications thereof by appropriate adjustments of the machine components and its working elements. At the same time, a continuous, objective and thus operator-independent analysis of the waste is ensured. Further, information concerning the type of the waste may be obtained based on suitable image-capturing and evaluating technology. In particular, it is possible to determine the proportion of the useful fibers and to change such a proportion, if required. Dependent on the determined results, machine elements may be adjusted in such a manner that a previously set, desired waste composition is automatically obtained. Also, information concerning the size of the separated impurities may be determined. Information concerning the consistency and the quantity of the waste may be directly read from the display device of the machine control panel and, if required, may be transmitted to superordinated data processing or similar systems.

DESCRIPTION OF THE PREFERRED EMBODIMENTS

Figure 1A:
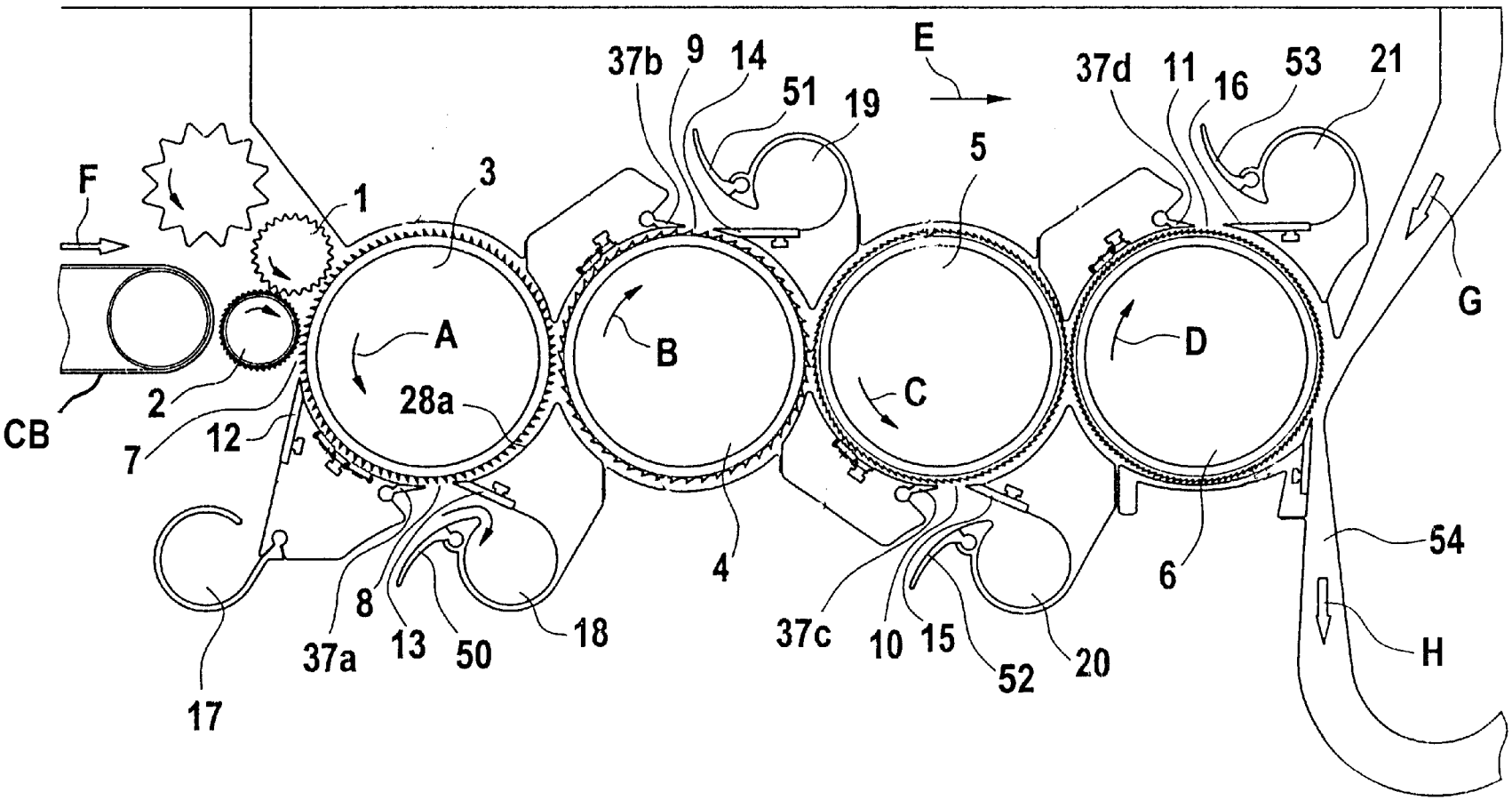
FIG. 1*a* is a schematic side elevational view of a fiber cleaning machine adapted to incorporate the invention.

FIG. 1*a* shows a fiber cleaner which may be, for example, a CVT 4 model, manufactured by Trützschler GmbH & Co. KG, Mönchengladbach, Germany. The fiber material designated with the arrow F, particularly cotton, is introduced into the cleaner as fiber tufts by a feeding device such as a conveyor belt CB. The fiber material is clamped by two feed rolls 1, 2 and advanced to a pin roll 3, rotating in the direction A. The pin roll 3 is followed by a sawtooth roll 4 rotating in the direction B. The pin roll 3 has a circumferential speed of approximately 10–21 m/sec whereas the sawtooth roll 4 has a circumferential speed of approximately 15–25 min/sec. The roll 4 is followed by further clothed rolls 5 and 6 which rotate in the direction C and D, respectively and which have increasing circumferential speeds as viewed in the fiber working direction E. The rolls 3–6 which have a diameter of approximately 150–300 mm are disposed in a closed housing.

The pin roll 3 cooperates with a separating opening 7 through which waste is discharged and whose size may be adjusted for adapting it to the degree of dirt contained in the cotton. The separating opening 7 is bordered by a mote knife 12. As viewed in the rotary direction A of the roll 3, a further separating opening 8 and mote knife 13 adjoin the roll periphery. Likewise, the rolls 4, 5 and 6 cooperate with respective separating openings 9, 10, 11, bordered by respective mote knives 14, 15 and 16. The separating openings 7–11 are in pneumatic communication with a respective suction hood 17–21.

Figure 1B:
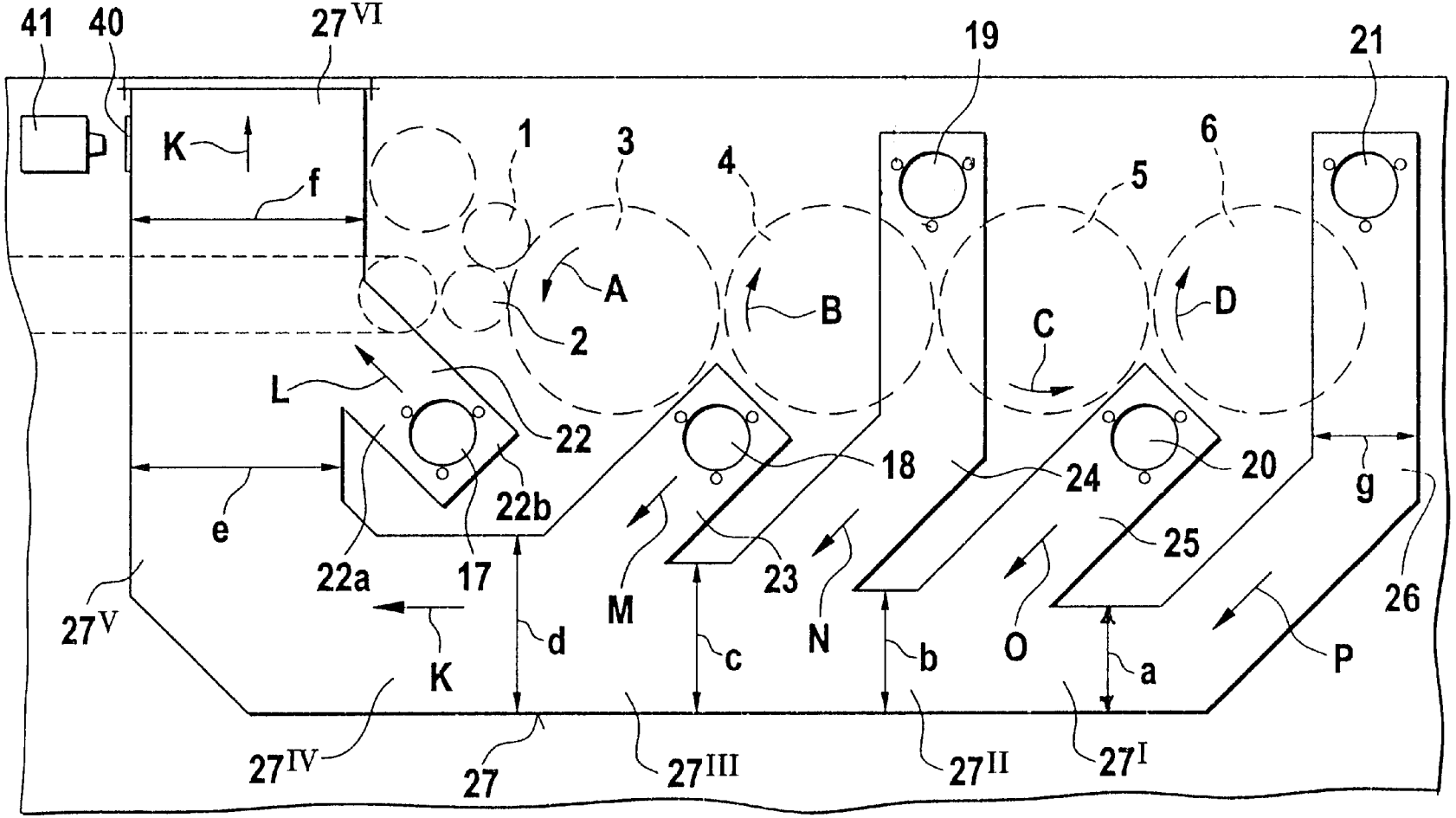
FIG. 1*b* is a schematic side elevational view of the invention incorporated in the fiber cleaner illustrated in FIG. 1*a*.

Also referring to FIG. 1*b*, the suction hoods 17, 18, 19, 20 and 21 are adjoined by respective suction conduits 22, 23, 24, 25 and 26 which, in turn, are coupled to a common suction channel 27. The rigid suction conduits 22–26 and the suction channel 27 are formed as a one-piece structure made of sheet metal or plastic material. The length of the suction ducts 22–26 is different, dependent on their distance between the respective suction hoods 17–21, on the one hand, and the suction channel 27, on the other hand. The suction channel 27 is composed of consecutive length portions $27^{I}$ through $27^{VI}$ having respective cross sections indicated at a through f which increase downstream of a suction conduit 22–26, as viewed in the flow direction K in the suction channel 27. The flow direction within the suction conduits 22–26 is designated with respective arrows L, M, N, O and P. The end of the suction channel 27 is adjoined by a non-illustrated suction source.

In the description which follows, the operation of the above-described apparatus will be set forth.

The fiber lap composed of fiber tufts F is advanced by the feed rolls 1, 2 to the pin roll 3 which combs the fiber material and entrains fiber bundles thereon. As circumferential parts of the roll 3 pass by the separating opening 7 and the mote knife 12, dependent on the circumferential speed and curvature of the roll 3 as well as the size of the separating opening 7 adapted to the first separating stage, waste (short fibers and coarse impurities) and a certain proportion of useful fibers are thrown out of the roll by centrifugal forces and, after traversing the separating opening 7 are introduced into the suction hood 17 provided in the cleaner housing. The fiber material pre-cleaned in this manner is taken off the first roll 3 by the clothing points of the roll 4 on which the fiber material is further opened. As circumferential parts of the rolls 4, 5 and 6 pass by the respective separating openings 9, 10 and 11 provided with the respective mote knives 14, 15 and 16, further impurities are thrown out of the fiber material by centrifugal forces. A suction stream G, H flowing in a duct 54, tangentially contacts the last roll 6 and removes the fiber material therefrom.

Air guiding elements 50, 51, 52 and 53 border the air inlet openings of the respective suction hoods 18–21 with which the flow rate of the vacuum air stream may be set. In the wall of the suction channel 217 a transparent plate (window) 40 is arranged to obtain visible access to the suction channel 27. Externally of the suction channel 27, a camera 41 is disposed which is aligned with the window 40 and which detects the waste flowing through the suction channel 27.

Figure 2:
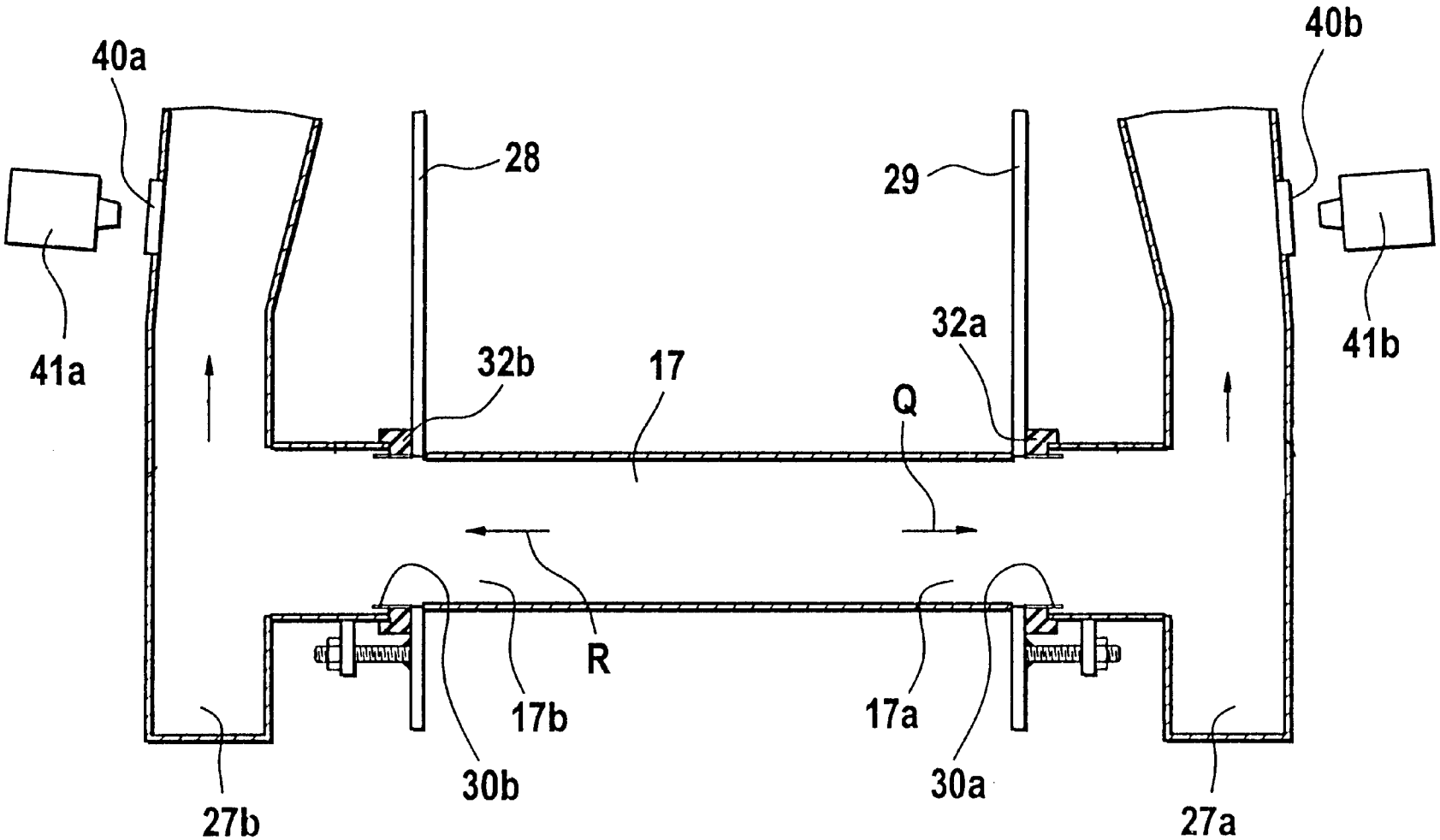
FIG. 2 is a sectional front elevational view of the fiber cleaner shown in FIG. 1*b*.

As shown in FIG. 2, the suction hood 17 is arranged between two machine frame walls (housing walls) 28, 29. Externally of the walls 28 and 29 at the ends 17*a*, 17*b* of the suction hood 17 a respective nipple 30*a*, 30*b* is provided whereby the suction hood 17 passes through two apertures provided in the housing walls 28, 29. The nipples 30*a*, 30*b* are surrounded by a respective annular elastic seal 32*a*, 32*b* made, for example, of foam material. One end region 22*a* of the suction duct 22 opens into the suction channel 27*a* (FIG. 1*b*), whereas the other end region 22*b* of the suction conduit 22 opens into the suction channel 27*b*. The ends of the suction channels 27*a*, 27*b* are coupled to a common removal channel 44 (FIG. 4) which is connected with a non-illustrated suction source.

As further shown in FIG. 2, on the outside of the suction channels 27*a*, 27*b* a respective transparent disk 40*a* and 40*b* is provided with which there is aligned a respective camera 41*a*, 41*b* arranged externally of the suction channels 27*a* and 27*b* for detecting the separated waste flowing therein. The waste stream inside the suction hood 17 is designated at Q and R.

Figure 3:
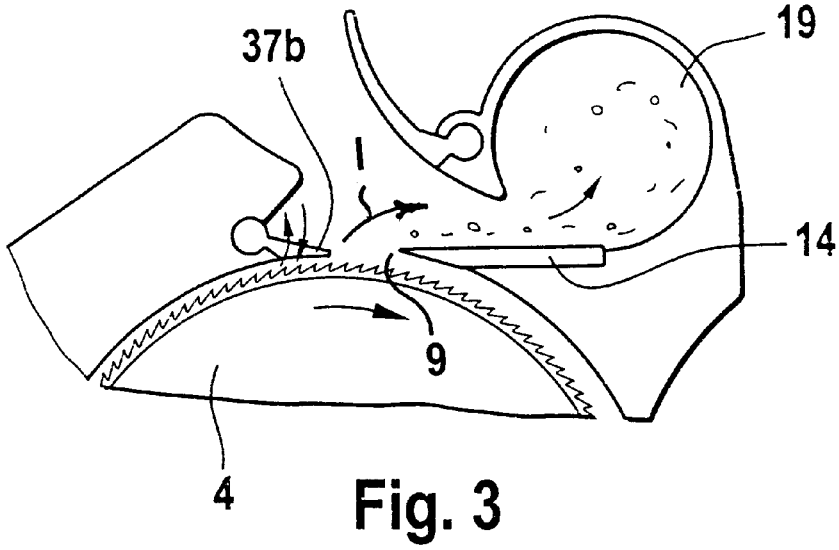
FIG. 3 is a fragmentary side elevational view of one part of the fiber cleaner shown in FIG. 1*a*, illustrating a location of waste separation.

The fiber cleaner illustrated in FIGS. 1*a*, 1*b* and 2 has devices with which the quantity and in part also the type of the separated waste (foreign particles, trash, neps, and the like) may be set or affected. The devices are motor-operated guide wings 37*a*–37*d* which are situated in the region of the respective rolls 3–6 upstream of the mote knives as viewed in the direction of rotation of the respective roll. By adjusting the angular position of the guide wings 37*a*–37*d* the quantity and, to a certain extent, the type of the separated material passing through the respective separating opening may be affected. FIG. 3 shows the guide wing 37*b* controlling the separating opening 9 to affect the quantity of the separated material I. The quantity of the separated material I is proportional to the size of the opening angle of the wing 37*b*. By setting the desired separated material I the cleaning effect of the machine for the useful fiber material is determined. Since, as a rule, useful fiber material is also separated, an acceptable practical compromise should be found. Stated differently, as much waste material as possible is separated while, at the same time, the proportion of the useful fibers is maintained at a minimum. To determine the separated material to thus be able to adapt it to the possible settings, the separated material I is analyzed in flight according to the invention.

Figure 4:
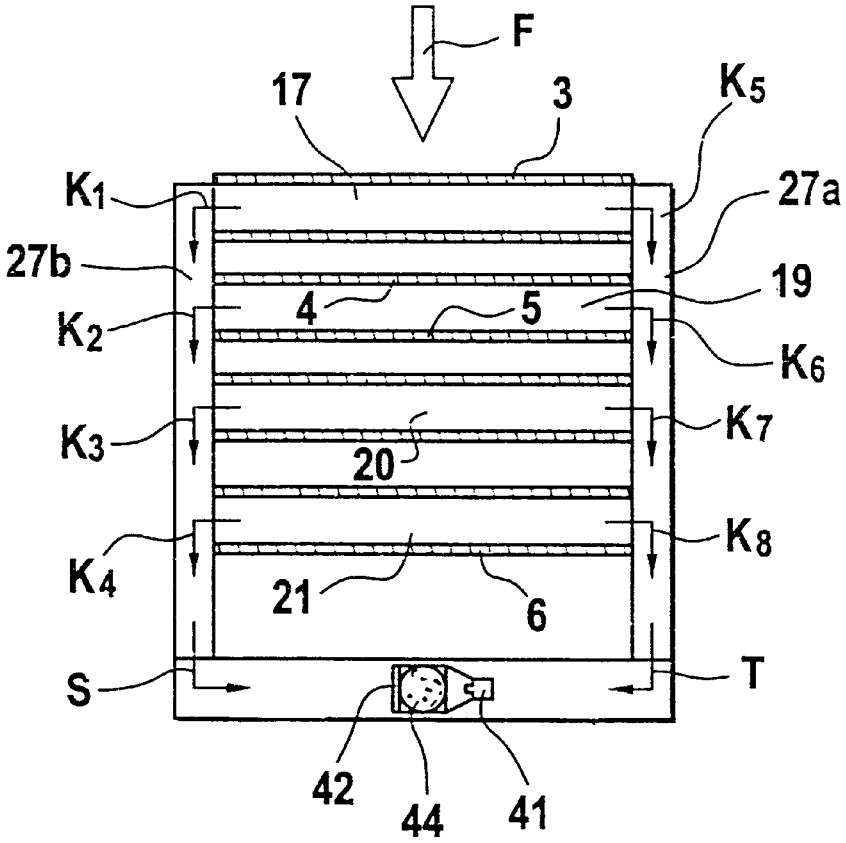
FIG. 4 is a schematic sectional top plan view of the construction shown in FIG. 1*b*.

Turning to FIG. 4, the separated material is gathered from the individual separating locations on each machine side and continuously transported by a vacuum stream in a conduit 44. According to the invention, an electro-optical camera system 41 with a suitable illuminating device 42 and evaluating unit are combined with the waste collecting conduit. The illuminating device may emit colored light, for example, in the red and/or infrared range. The system is oriented in such a manner that it can detect the fiber material as well as other particles as they flow in the conduit 44. Further, the system can distinguish between individual materials and also can supply information concerning quantity and size. Dependent on previously inputted data, the machine components (for example, the guide wings 37*a*–37*d*) which affect the separated material are automatically adjusted until the desired waste quality is reached. $K_1$–$K_8$, S and T designate suction streams.

Figure 5:
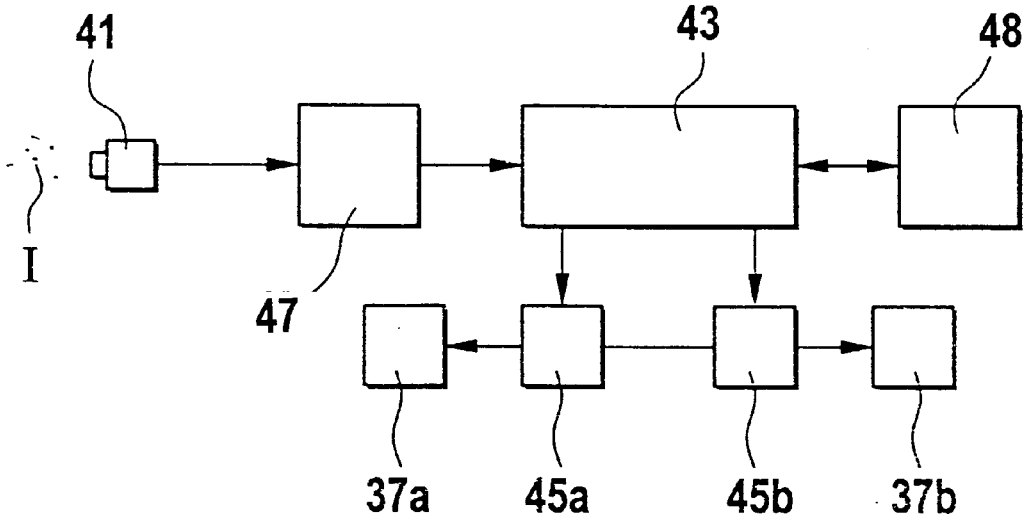
FIG. 5 is a block diagram showing an electronic control and regulating device, a camera, an evaluating device, an operating and display device and a setting device for the fiber guide wings are shown.

As shown in FIG. 5, an electronic control and regulating device 43 (machine control), for example, a microcomputer, is connected to the camera 41 (for example, a CCD camera) with the intermediary of an image evaluating device 47, an operating and display device 48 and two adjusting mechanisms 45*a*, 45*b* for setting the guide wings 37*a* and 37*b*. Further adjusting mechanisms for setting the other guide wings 37*c* and 37*d* are not shown.

Figure 6:
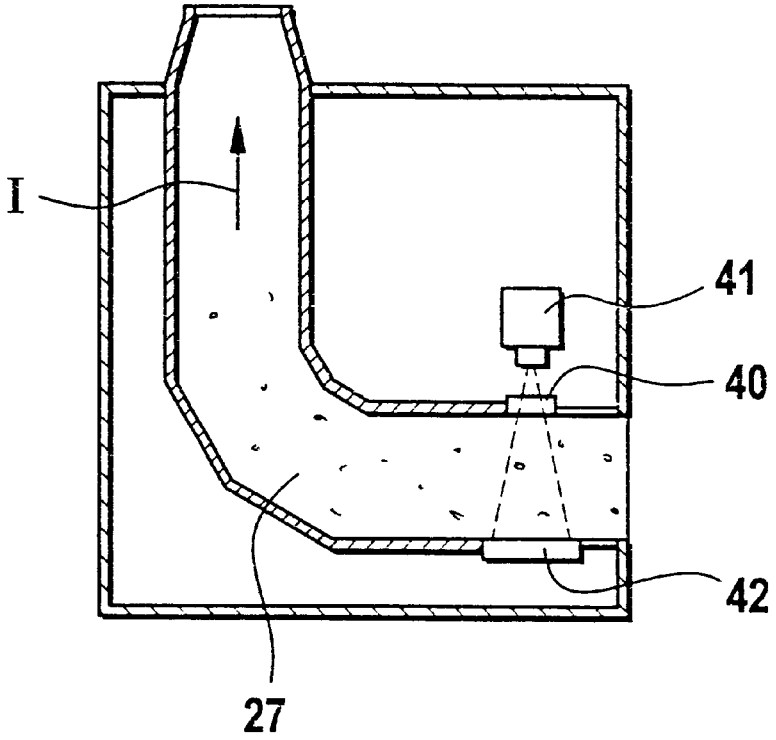
FIG. 6 is a schematic sectional side elevational view of a waste collecting conduit, a camera and an illuminating device.
Figure 7:
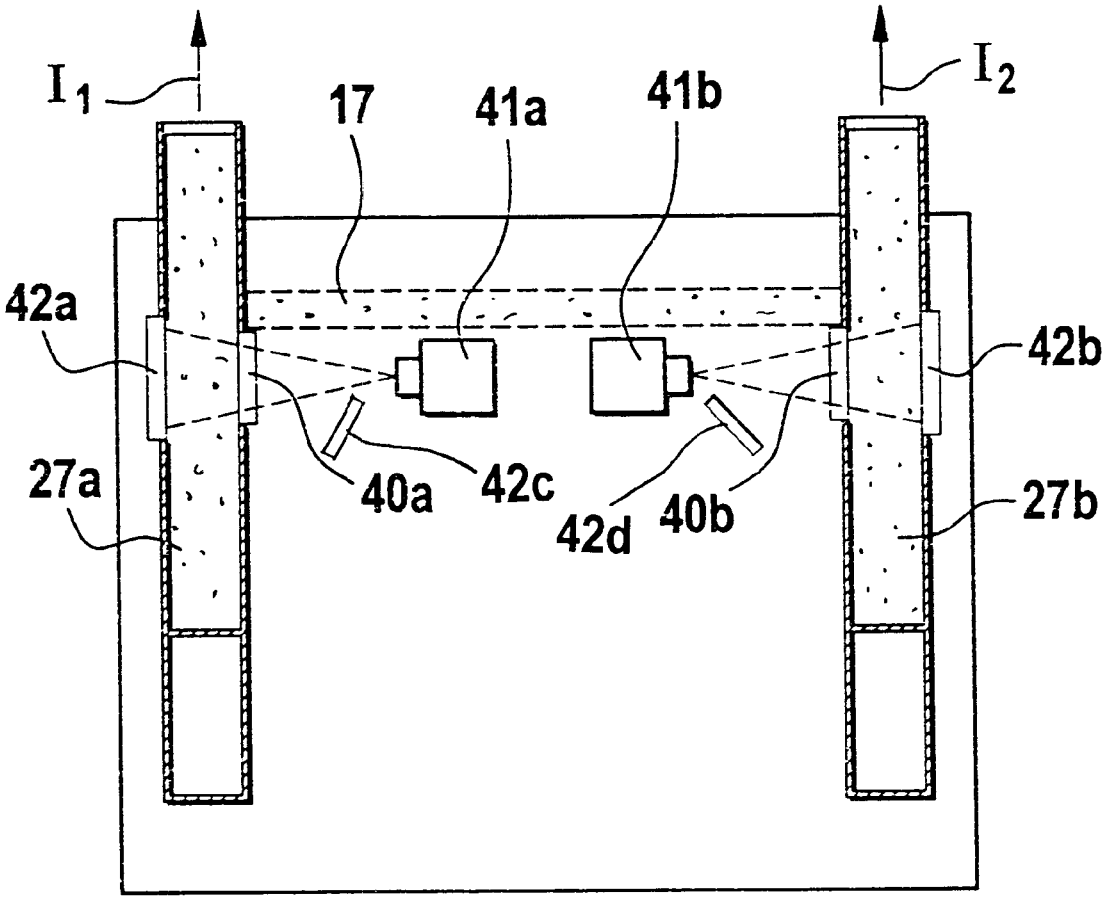
FIG. 7 is a schematic view illustrating the arrangement of waste conduits and associated cameras on opposite lateral sides of the cleaner of FIG. 1*b*.

FIGS. 6 and 7 show different arrangements of the detecting devices within a cleaning machine. FIG. 7 is similar to the arrangement illustrated in FIG. 2, showing back-to-back cameras 41*a* and 41*b*, provided with illuminating devices (light sources) 42*a*–42*d*. The light sources 42*a* and 42*b* associated with the cameras 41*a*, 41*b* are used for picture-taking in transmitted light, whereas the light sources 42*c* and 42*d* associated with the cameras 41*a*, 41*b* are used for picture-taking in reflected light. The waste material flowing in ducts 27*a*, 27*b* is designated at $I_1$ and $I_2$, respectively. If the fiber processing machine includes a plurality of adjustable elements for determining the waste quality, then, as a rule, such elements have different basic settings. In case a central waste detecting device is used, the elements are, for example, adjusted proportionally to their basic setting. Essentially, however, in the device according to the invention, other adjusting possibilities (for example, cleaning-roll oriented) may be present. These may be inputted (manually or by a communications network), stored and, if needed, re-used at a later time. A manual adjustment of all of these values is also feasible.

The invention, as described above, yields the following advantages:

A continuous, objective and thus operator-independent evaluation of the separated waste is obtained.

Information concerning the type of the waste may be obtained based on appropriate picture-capturing and image-evaluating technology. Thus, for example, it is feasible to determine the proportion of useful fibers separated with the waste and, if required, to change such a proportion.

As a function of the obtained results, machine elements, such as guide wings and mote knives, may be adjusted to automatically obtain a previously determined and desired waste combination.

Further, information concerning the size of the separated impurities may be obtained.

Information concerning the consistency and quantity of the waste may be directly read from the operating and display device 48 and, if required, may be transferred to superordinated data processing system or other systems.

Figure 8:
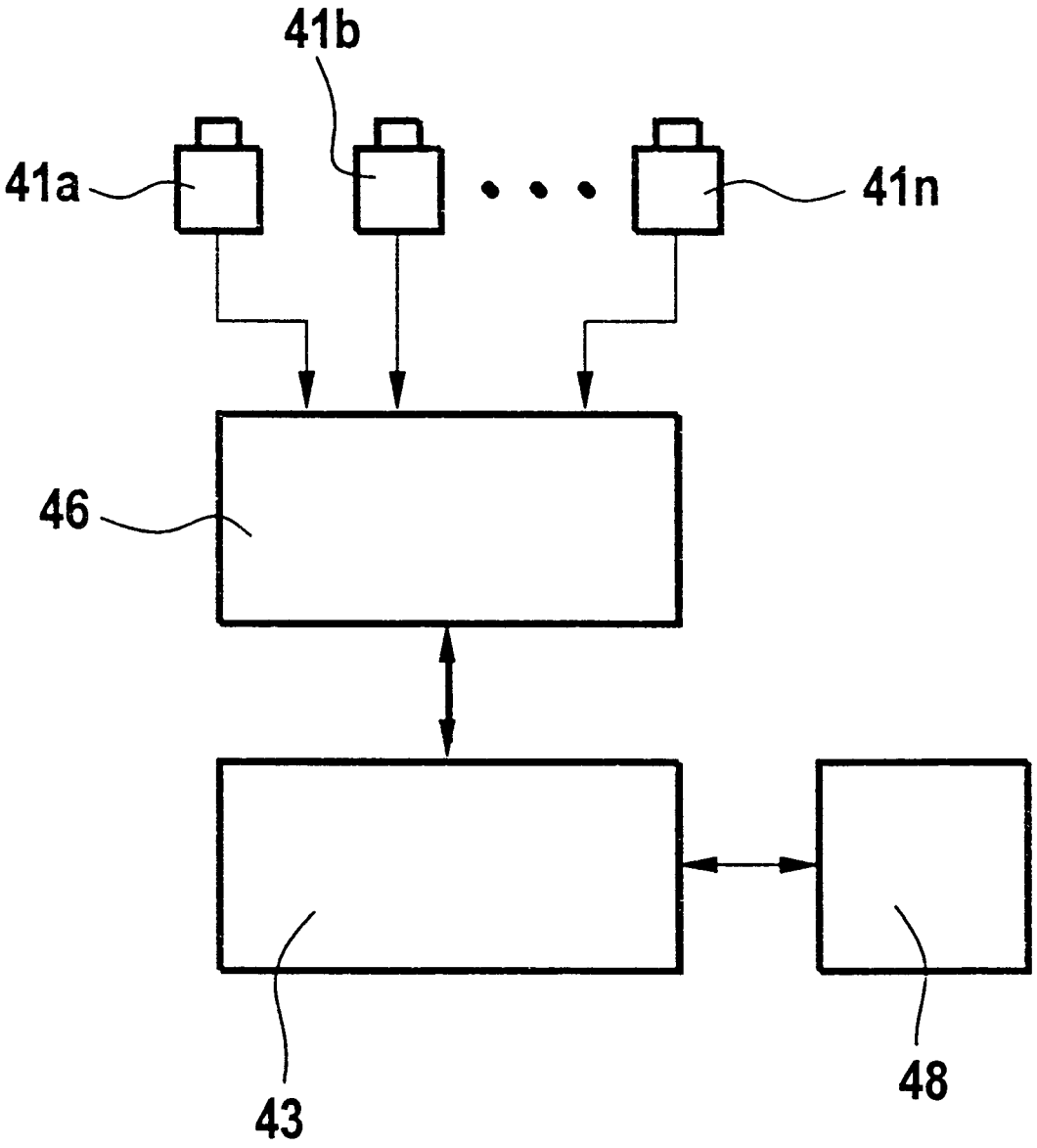
FIG. 8 is a block diagram illustrating a central evaluating device, a plurality of cameras and an electronic control and regulating device.

Turning to FIG. 8, for each fiber-separating location a separate camera 41*a*–41*n* may be used and in such a case the cameras may be connected to a single, central evaluating device 46 to ensure a cost-effective solution.

Further, only a single communication connection with the machine control 43 is required and numerous necessary functions and image evaluation may be jointly used by the cameras 41*a*–41*n*.

A control of separating organs (such as guide wings 37*a*–37*d*) according to the invention as a function of the determined consistency or quality of the separated material may be used, apart from the described fiber cleaner, in all machines (particularly carding machines) which have such separating organs.

In case of suitable pre-given data, the system may also determine the weight of the separated material with acceptable accuracy. Thus, since the output rate is known, information concerning the ratio of useful material to waste material may be obtained. Since the type and size of the separated particles is determined, based on weight information which is obtained once empirically, corresponding data may be produced.

EXAMPLES

For all the separated particles a relationship exists between number, type, size and weight. If the latter relationships is determined and given, then based on the determinations obtained according to the invention concerning type and number, corresponding weight information may be obtained with sufficient accuracy.

By relating these values to time, information is obtained as to how much weight of material per time may be separated. If the known production rate is taken into consideration and a ratio to the separated material values is formed, a percent information concerning the separated material may be obtained (for example, 3% of the fiber material is separated as waste).

It is a further advantage of the invention that limit values for certain parameters can be determined.

A warning signal may be emitted when the separated quantity is greater than a predetermined weight value.

Further, from an analysis of automatically obtained material-specific statistics the proportion of impurities may be determined for the different materials. In this manner a customer may be optimally supported, for example, in the selection of the correct basic material for certain products.

It will be understood that the above description of the present invention is susceptible to various modifications, changes and adaptations, and the same are intended to be comprehended within the meaning and range of equivalents of the appended claims.

What is claimed is:

1. A fiber processing machine comprising (a) a clothed roll having a surface for entraining fiber material thereon and a direction of rotation;

(b) a housing at least partially surrounding said clothed roll and conforming to the roll surface;

(c) separating means for separating waste material carried on said roll;

(d) a separating opening provided in said housing and adjoining said separating means; said separating opening extending along and adjacent a circumferential portion of said roll for receiving waste material separated from the fiber material;

(e) means for introducing fiber material to said roll at a location upstream of said separating opening as viewed in said direction of rotation;

(f) detaching means for detaching fiber material from said roll; said detaching means acting on the fiber material on said roll and being situated at a location circumferentially spaced from said separating opening along said roll; said detaching means being positioned downstream of said separating opening as viewed in said direction of rotation;

(g) a waste conduit being in pneumatic communication with said separating opening for carrying waste material away from said roll;

(h) a camera adjoining said waste conduit for capturing pictures of the waste material flowing therein; and (i) an electronic image processing device connected to said camera.

2. The fiber processing machine as defined in claim 1, further comprising a light source for illuminating the fiber material in said waste conduit; said camera and said light source being situated on a same side of said waste conduit for capturing pictures in reflected light.

3. The fiber processing machine as defined in claim 1, further comprising a light source for illuminating the fiber material in said waste conduit; said camera and said light source being situated on opposite sides of said waste conduit for capturing pictures in transmitted light.

4. The fiber processing machine as defined in claim 1, further comprising light sources of different color for illuminating the fiber material in said waste conduit.

5. The fiber processing machine as defined in claim 1, further comprising an infrared light source for illuminating the fiber material in said waste conduit.

6. The fiber processing machine as defined in claim 1, further comprising (i) an adjustable guide wing disposed at said separating opening for varying a flow rate of the waste material passing through said separating opening; and (j) a control device connected to electronic image processing device and said guide wing for adjusting said guide wing as a function of signals applied to said control device by said electronic image processing device.

7. The fiber processing machine as defined in claim 1, further comprising an adjustable guide wing bordering said separating opening and an electronic regulating device; further wherein said guide wing is operatively connected to the regulating device for being adjusted as a function of signals representing measuring results obtained from said image processing device.

8. The fiber processing machine as defined in claim 1, further comprising an electronic control and regulating device connected to said image processing device.

9. The fiber processing machine as defined in claim 1, further comprising a plurality of cameras connected to said image processing device.

10. The fiber processing machine as defined in claim 1, further comprising a machine control device connected to said image processing device.

11. The fiber processing machine as defined in claim 1, further comprising a machine operating and display device operatively coupled to said image processing device for displaying evaluated measuring results derived from images taken by said camera.

12. A fiber processing machine comprising (a) a plurality of serially disposed clothed rolls, each having a surface for entraining fiber material thereon;

(b) a housing at least partially surrounding at least some of said rolls and conforming to the roll surface;

(c) separating openings provided in said housing; said separating openings extending along and adjacent a circumferential portion of respective said rolls for receiving waste material thrown from said rolls;

(d) waste conduits leading from each separating opening for carrying waste material away from said rolls;

(e) a collecting conduit into which said waste conduits merge;

(f) a camera adjoining at least one of said conduits for capturing pictures of the waste material flowing therein; and (g) an electronic image processing device connected to said camera.

13. The fiber processing machine as defined in claim 12, wherein said camera adjoins said collecting conduit.

14. The fiber processing machine as defined in claim 12, wherein a plurality of cameras are provided; each said conduit being adjoined by a separate camera.

* * * * *

UNITED STATES PATENT AND TRADEMARK OFFICE

CERTIFICATE OF CORRECTION

PATENT NO. : 6,477,741 B2
DATED : November 12, 2002
INVENTOR(S) : Fritz Hösel

It is certified that error appears in the above-identified patent and that said Letters Patent is hereby corrected as shown below:

Title page,
Insert -- [30] Foreign Application Priority Data DE 100 63 861.9
December 21, 2000 --

Signed and Sealed this

Twenty-fifth Day of February, 2003

JAMES E. ROGAN
*Director of the United States Patent and Trademark Office*